US006490959B2

(12) United States Patent
Lavin

(10) Patent No.: US 6,490,959 B2
(45) Date of Patent: Dec. 10, 2002

(54) RECOILLESS TELESCOPING BARREL GUN

(76) Inventor: Walter M Lavin, P.O. Box 1362, 632 Glenwood Ave., Wildwood, NJ (US) 08260

( * ) Notice: Subject to any disclaimer, the term of this patent is extended or adjusted under 35 U.S.C. 154(b) by 0 days.

(21) Appl. No.: 09/950,493

(22) Filed: Sep. 11, 2001

(65) Prior Publication Data

US 2002/0029688 A1 Mar. 14, 2002

Related U.S. Application Data

(60) Provisional application No. 60/233,058, filed on Sep. 14, 2000.

(51) Int. Cl.[7] ..... F41A 3/00
(52) U.S. Cl. ..... 89/161
(58) Field of Search ..... 89/159, 161; 42/10

(56) References Cited

U.S. PATENT DOCUMENTS

| | | | | | |
|---|---|---|---|---|---|
| 570,145 | A | | 10/1896 | Pittavino | |
| 726,399 | A | * | 4/1903 | Burgess | 42/7 |
| 822,851 | A | * | 6/1906 | Burgess | 42/11 |
| 855,439 | A | | 6/1907 | Adrianson | |
| 886,211 | A | * | 4/1908 | Hino et al. | 42/11 |
| 2,852,880 | A | | 9/1958 | Kaufman | |
| 2,865,256 | A | * | 12/1958 | Marsh | 89/191.01 |
| 2,880,543 | A | | 4/1959 | Von Frantzius | |
| 3,707,794 | A | | 1/1973 | Rocha et al. | 42/1 |
| 3,736,839 | A | * | 6/1973 | Childers | 42/41 |
| 3,824,727 | A | | 7/1974 | Hudson | |
| 4,028,994 | A | * | 6/1977 | Ferluga | 42/10 |
| 4,061,075 | A | * | 12/1977 | Smith | 42/11 |
| 5,123,329 | A | * | 6/1992 | Irwin | 89/14.3 |

* cited by examiner

*Primary Examiner*—Charles T. Jordan
*Assistant Examiner*—Jordan Lofdahl

(57) ABSTRACT

In order to provide a gun in which the recoil force attendant with actuation is reduced, a prototype model of a telescoping barrel gun has been designed. In this design, an inner barrel, which contains and directs the projectile, is made to slide forward within an outer barrel when the gun is actuated. The motion of the inner barrel is then stopped while the projectile moves unimpeded. The telescoping barrel design functions together with a design which requires a portion of the cartridge's propellant energy be used to produce a reduction in the force of the gun's recoil when fired. Upon firing, some of the propellant gases are channeled forward in the gun to an air space, which lies between the two concentric barrels. The forward motion of the inner barrel forces the gases in this air space from the gun through small holes located in the distal area of the outer barrel. The discharge of these gases is rearwardly directed in order to counteract the gun's recoil. After firing, the gun must be manually reloaded and the member's reassembled to their pre-actuation positions before firing again.

4 Claims, 4 Drawing Sheets

RECOILLESS TELESCOPING BARREL GUN

CROSS REFERENCE TO RELATED APPLICATIONS

This application is a continuation-in-part of U.S. Provisional Patent Application No. 60/233,058, filed Sep. 14, 2000, and claims priority benefit thereof.

BACKGROUND OF THE INVENTION

This invention relates, in general, to a gun and in particular to a gun with two barrels, one of which moves forward upon actuation.

Examination of U.S. Patent Literature reveals an absence of interest in guns with a delivery system containing two barrels, one of which, upon firing, is made to slide within an outer structure, like the sections of a small telescope. But a gun that is designed to produce, upon firing, the acceleration of both a projectile and also the immediate container of the projectile in the same direction and in such a manner that after moving a distance together, the immediate container of the projectile is mechanically stopped before exiting the gun, and remains a useable part of the gun while the projectile is driven forward, may have utility. This telescoping design differs from conventional guns by requiring both the bullet and an inner barrel, containing the bullet, be driven forward by the explosion of propellant. By design, an outer structure contains and directs the force of the propellant, and moves in a direction opposite that of the bullet and inner barrel (recoil).

In ballistic technology, several mechanisms exist for rearward movement of parts within a gun, as an action, which is governed by the force of recoil or the propellant gases generated by firing, however, a barrel which moves forward has elicited little interest. Though a gun with a telescoping barrel has an obvious advantage over conventional guns, in that higher projectile velocities might result from its use than is apparent judging from the outer structure barrel length; a gun with a barrel that moves with the projectile for an appreciable distance within the gun has not been pursued as a viable firearm concept, most likely because stopping a barrel that has been accelerated to a velocity which is a significant fraction of the bullet's speed is hard to accomplish. If the barrel moves too fast, it will exit the gun; too slow and the benefits of the concept are minimal. Additionally, abrupt starting and stopping of the moveable barrel results in a stretching of the barrel's metal, as defined by Young's modulus, rendering the gun incapable of repeated use. These additional variables involved in perfecting a gun with a telescoping barrel seem to indicate that a weapon of such design is impractical. However, a gun that is designed to produce, upon firing, the acceleration of the projectile and also the immediate container of the projectile can be used to transfer some of the kinetic energy of the moving container of the projectile into energy that counteracts the force of the gun's recoil, while the projectile is driven forward in the usual way. This invention is thought to be novel and different from other gun designs which utilize some of the energy of the propellant gases to counteract the force of the gun's recoil, notably the designs of Sir Dennis Burney and subsequent battalion anti-tank guns developed in Britain in the late 1940's, by requiring that some of the burning propellant energy be converted into kinetic energy of a moving structure within the gun, i.e. a telescoping barrel, and this energy be then used to counteract the gun's recoil.

Adrianson, U.S. Pat. No. 855,439 simply shows a telescoping barrel for a gun, and the barrel does not telescope as the bullet is fired.

Kaufman, U.S. Pat. No. 2,852,880 simply shows a gun having a second barrel that screws into internal threads in a rear barrel portion. Again, the barrel does not telescope as the bullet is fired, and the threaded barrel is just provided for disassembly into a smaller length.

Von Frantzius, U.S. Pat. No. 2,880,543, shows a tear gas pistol, and FIGS. 6–7, with accompanying text in column 3, describes a bullet being fired from the tear gas pistol. Although the device does have a barrel that threadingly screws into the body of the pen, there is no barrel that telescopes as a bullet is fired.

Pittavino, U.S. Pat. No. 570,145 simply shows a barrel extension for a gun. The barrel does not telescope as a bullet is fired.

Hudson, U.S. Pat. No. 3,824,727 shows a small pen that fires miniature caliber projectiles. The barrel does not telescope as a projectile is fired.

Whatever the precise merits, features, and advantages of the above cited references, none of them achieves or fulfills the purposes of the telescoping barrel gun of the present invention. Accordingly, an object of the present invention is to provide a novel gun consisting of, among other things, a design including two barrels, one barrel of which moves forward within the other barrel upon actuation.

It is another object of this invention to provide a gun capable of producing projectile velocities higher than conventional guns of the same apparent barrel length, since the apparent barrel length of a telescoping barrel gun is the length of the external barrel, while the real barrel length, the distance the projectile travels while enclosed in a telescoping barrel gun is greater than the external barrel length.

A further object of this invention lies in the provision of a gun wherein the movement of the telescoping barrel is used in such a way as to counteract the recoil movement thereof responsive to the actuation of the gun.

SUMMARY OF THE INVENTION

The invention relates to a gun in which the inner barrel, which contains and directs the projectile, is made to slide forward within an outer structure or barrel when the gun is actuated. It differs from conventional gun designs by requiring both the projectile and an internal barrel to be driven forward by the explosion of propellant. When the gun is fired, the force of the detonation is contained by the breech area of an external structure and directed against the moveable parts contained within the breech area of the external structure. These parts include both the projectile and an internal barrel. The projectile resides within the internal barrel and, upon firing, is not constrained within the bore of this barrel and is driven forward, while the inner barrel also moves forward within the external structure. The motion of the inner barrel is then stopped while the projectile moves unimpeded. After the gun is fired, it must be manually reassembled to it's pre-actuation position for continued use.

If the burning characteristics of the propellant are required to produce a high breech pressure throughout the projectile's path in the gun, this telescoping design may be used to produce a projectile velocity which is higher than conventional guns of the same apparent barrel length since the projectile travels under the force of the propellant energy for a greater distance than the length of the outer barrel structure or the gun's apparent length.

The gun also uses the telescoping design to allow a portion of the cartridge's propellant energy be used to produce a significant reduction in the force of the gun's recoil when fired. The cartridge canister and firing chamber of the gun are designed to allow some of the burning propellant gases to be channeled forward in the gun to an air space which lies between the two concentric barrels of the gun, in the early moments of cartridge detonation before the projectile and internal barrel attain an appreciable velocity. As the propellant burns and the pressure rises in the breech, a series of grooves in the firing chamber of the external barrel act as a conduit in transferring some gas from the firing chamber to this air space or forward chamber in the gun. When the pressure in the firing chamber becomes sufficient to overcome the inertia of the projectile and the internal barrel, both parts move forward. The forward motion of the internal barrel further compresses the already high-pressure gasses trapped within the forward chamber, lying between the two barrels.

This motion and also the high internal pressure of the enclosed gases, forces the gases from the gun through small voids or holes located in the distal body of the external barrel. The gases escape in a rearward direction in order to counteract the gun's recoil. The work accomplished by the internal barrel in the forced expulsion of the gases from the external barrel appreciably reduces the velocity of the internal barrel and this slowing, together with a pressure activated ablation of the surface of the internal barrel as it moves through the external barrel, stops the internal barrel before it contacts the forward end of the external barrel. The greater part of the kinetic energy of the moving internal barrel is thought to be utilized in raising the pressure or potential energy of the gases confined in the forward chamber as the internal barrel slows and stops within the external barrel. This increase in potential energy of the confined gases significantly increases the exit velocity of the rearward directed jet streams leaving the forward chamber from the voids in the internal barrel. The compression of the gases by the moving telescoping barrel significantly helps to counter the rearward momentum of the gun produced by the exiting projectile and results in requiring less propellant gases be diverted and ejected in overcoming the gun's recoil.

In order to accomplish the foregoing objects of this invention, the gun described consists of four main members:

A firing mechanism.

An external barrel, which contains a firing chamber, an internal barrel, and also an ablative mechanism.

An internal barrel which moves forward while containing the projectile as the gun is actuated.

An ablative mechanism that aids in slowing the internal barrel and preventing its exiting the gun.

The firing mechanism of the present invention comprises a forwardly biased longitudinal firing member or striker slidably mounted on a tubular housing which includes a removable forwardly extending external barrel portion. A transverse rod is fixedly secured to the rear end of the striker. In order to fire a cartridge chambered in the external barrel portion of the gun, the rod is manually retracted against the action of a spring and subsequent release of the rod causes this firing pin to be snapped forward, firing the cartridge.

The external barrel is an elongated metal tube closed on the proximal end by a threadably secured breech cap, which houses a breechblock that surrounds a centrally located aperture for accommodating a firing pin. The external barrel is partially closed on the distal end by reducing the bore diameter, which is preferably constant throughout the external barrel, by the inclusion of an internal metal flange.

Lying within the bore of the external barrel, forward the firing chamber, another tubular member, the internal barrel is disposed. The internal barrel is a metal cylinder open on both ends, with two annuluses fixedly secured to the outer surface of the proximal end of the barrel. The annuluses house a common rubber o-ring between them. The internal barrel is disposed within the external barrel and houses the projectile within its bore. The internal barrel abuts, with its base breech face, the cartridge canister, which is positioned within the firing chamber of the external barrel. The internal barrel is held in place within the external barrel by the frictional forces of the annuluses and o-ring, which communicate and bear against the internal surface of the external barrel. As the gun is fired, the internal barrel is free to forwardly slide within the bore of the external barrel.

The actual body or metal surface of the external barrel is altered by a design that aids in counteracting the force of the gun's recoil. A series of grooves in the internal metal surface of the external barrel extend from the firing chamber longitudinally forward to a position adjacently forward the annuluses on the internal barrel. These grooves divert some of the burning propellant gases generated upon firing to a forward chamber within the gun. The forward chamber is an air space existing between the concentric surfaces of the two barrels, forward the annuluses of the internal barrel and rearward the flange of the external barrel. The propellant gases are pushed to the forward chamber, upon cartridge detonation, before the projectile and internal barrel move an appreciable distance within the gun. As the remaining propellant in the firing chamber burns, the pressure in the breech area of the gun increases to a point where the projectile and the internal barrel are appreciably accelerated by the impact of a semi-rigid piston, which prior to firing is positioned within the top rim of the cartridge. The semi-rigid piston is designed to prevent the propellant gases from influencing the projectile until a predetermined firing chamber pressure is established which causes the piston to rupture. When the semi-rigid piston ruptures, the propellant gases force both the piston and the projectile through the internal barrel. The forward movement of the internal barrel forces the gases, which have accumulated in the forward chamber, through voids located in the distal end of the external barrel. These voids conduct gases in the forward chamber through the metal body of the external barrel to the environment. The expelled gases are directed onto the exterior surface of the telescoping barrel as it moves forward, upon firing, by a series of metal structures or protrusions, which contain and direct the individual voids. The protrusions are positioned along the circumference of the external barrel, on the far distal area of the barrel, forward the internal flange of the external barrel. The protrusions direct the voids inward and rearward so the expelled gases push the gun in a forward direction.

A pressure sensitive ablative mechanism is also disposed in the distal portion of the forward chamber and comprises an ablative material securely affixed to an elastomer backing which functions to further slow and stop the forward motion of the internal barrel. The mechanism ablates the outer surface of the internal barrel, as it moves forward, upon firing, and the frictional forces of the ablation de-accelerate the barrel. This member is included in the gun as a means to control the speed of the internal barrel so that, after firing, the internal barrel and also the gun and its other members are relatively undamaged and capable of repeated use.

The gun is re-fired by unscrewing the breech cap from the external barrel, removing the fired case, replacing a live cartridge projectile, and repositioning the internal barrel so that its base breech face abuts the cartridge case with the projectile enclosed within the bore.

The gun described is a prototype model and used to illustrate the essential design of the invention. Since the invention relates to the initiation and projectile propagation systems of a gun, only the firing mechanism, cartridge, breech and barrel mechanisms are described. Most state of the art mechanisms involving other systems that are necessary or facilitate gun use are thought to be compatible and integratable with the mechanisms that are discussed.

BRIEF DESCRIPTION OF THE DRAWING

The specific nature of the invention as well as other objects and advantages thereof will clearly appear from a description of a preferred embodiment as shown in the accompanying drawings in which.

DESCRIPTION OF A PREFERRED EMBODIMENT

Figure 1:
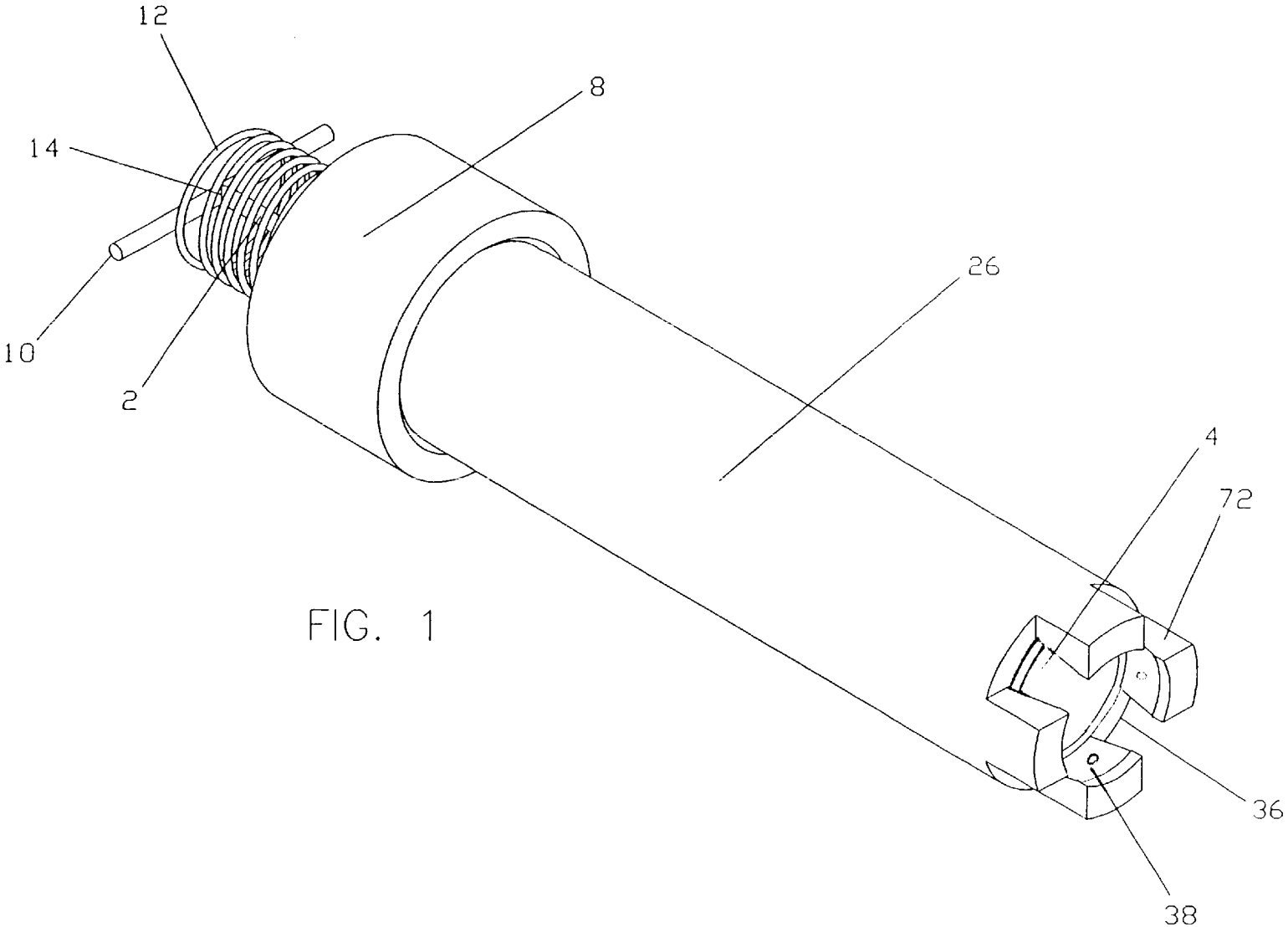
FIG. 1 is a perspective view of the gun.
Figure 2:
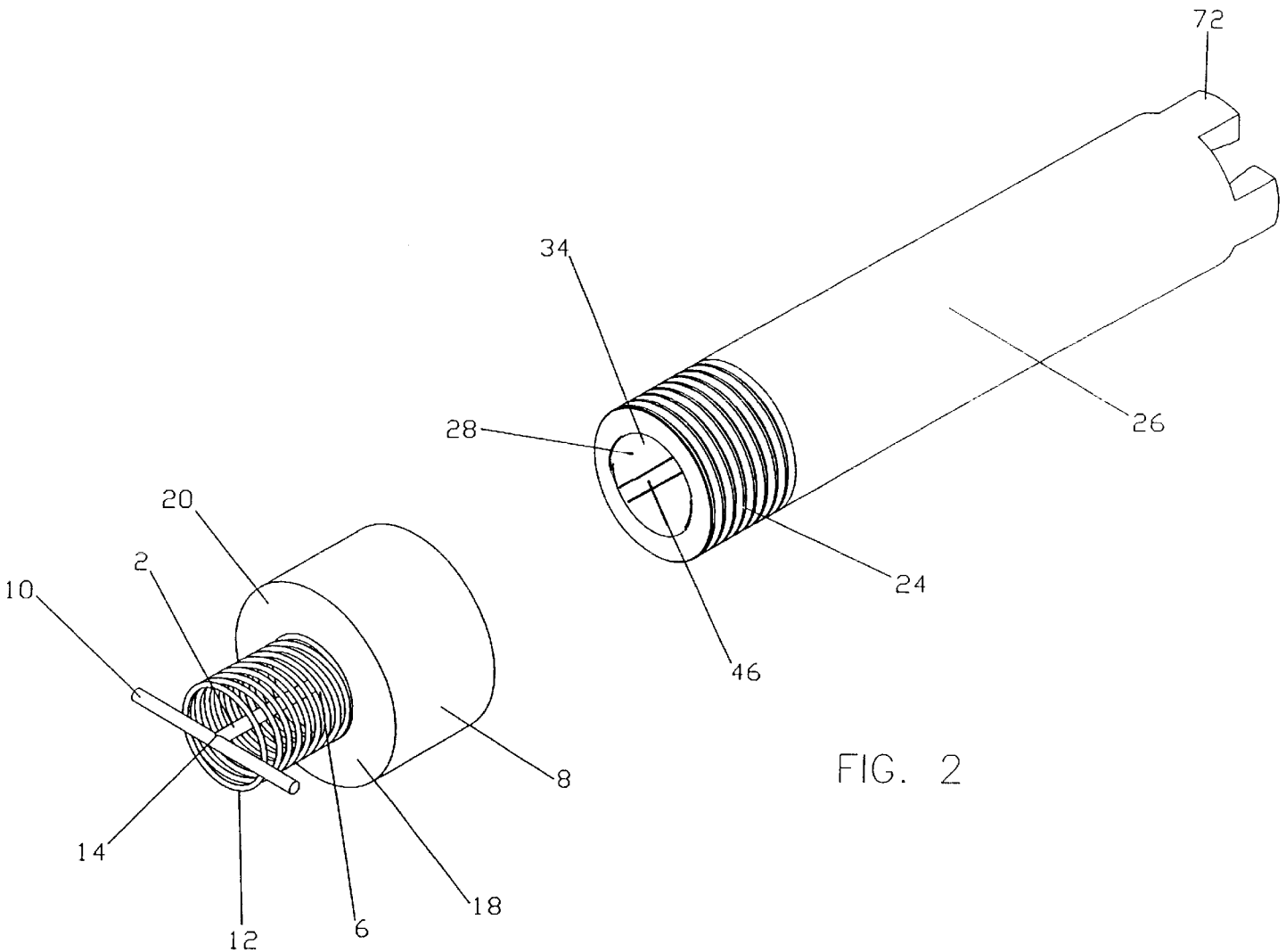
FIG. 2 is a perspective view showing the screw-off breech cap and groove in the external barrel.
Figure 3:
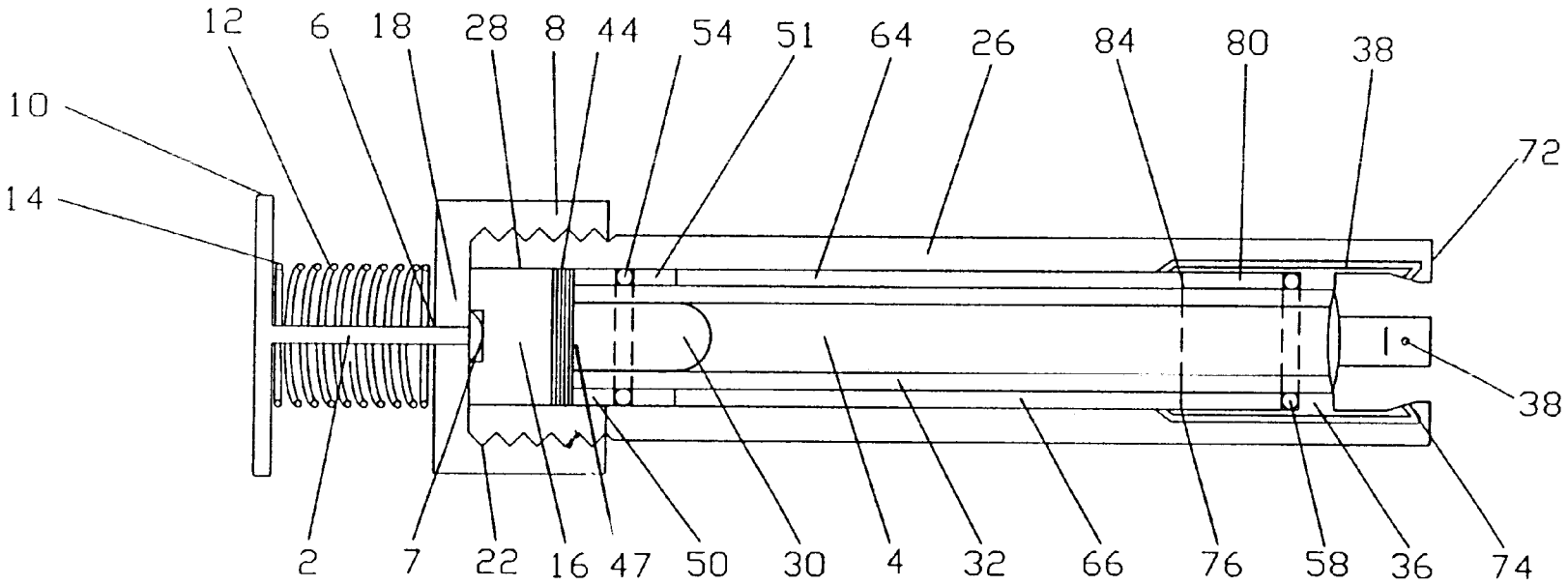
FIG. 3 is a sectional view of the gun.
Figure 5:
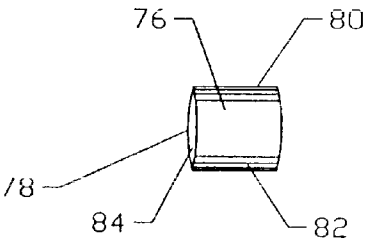
FIG. 5 is a perspective view of the ablative mechanism.
Figure 4:
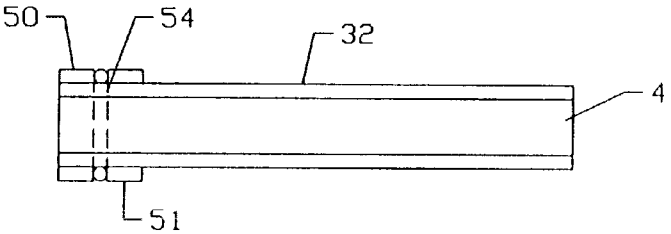
FIG. 4 is a sectional view of the internal barrel.

The firing mechanism of the present invention comprises a forwardly biased longitudinal firing pin (2) or striker (2) slidably mounted in a tubular aperture (6) centrally located in breech block (18) on breech cap (8). A transverse rod (10) is fixedly secured to the ear end of the firing pin (2) and the rear end of the expansion spring (12) as shown at (14), surrounding firing pin (2). The forward end of the expansion spring (12) is fixedly secured to he outer surface of the base of breech cap (8). Expansion spring (12) surrounds firing pin (2) from the location of the rod (10) to the point firing pin (2) enters the aperture (6) of the breech cap (8). Firing pin (2) is actuated by manual retraction of the rod (10) against the action of the spring (12) and then subsequent release of rod (10), which causes firing pin (2) be snapped forward, striking primer (7), firing the cartridge (16).

Breech block (18) and striker housing (20) are circumferentially secured to a tubular structure which forwardly extends and is internally threaded as indicated at (22), to receive the proximally threaded external end, at (24), of another tubular member which serves as the external barrel (26) of the gun. It includes firing chamber (28) for seating a cartridge (16) and a forward area through which projectile (30) and internal barrel (32) move.

The external barrel (26) is a tubular cylinder with bore (34), the internal diameter of which is essentially the same in the proximally located firing chamber (28) and the forward portion of the barrel. External barrel (26) narrows in an internal metal flange (36) at the distal end of the bore (34) of the barrel. At the far distal end of external barrel (26), forward a short distance from flange (36) the structure of the barrel continues and includes a series of metal protrusions (72) which extend longitudinally from the barrel's distal base. The protrusions (72) house holes or voids (38) within their metal structures which function to direct and carry gases from within the gun. The voids (38) and surrounding metal protrusions (72) extend longitudinally forward for a distance beyond flange (36) of external barrel (26) and then change direction and turn to face rearward, at an angle, toward the breech portion of the gun. To counter the force of the gun's recoil, the protrusions (72) are made to direct the escaping gases rearward at an acute angle with the vertical plane of the gun and facing inward toward the internal barrel (32) as indicated at (74) not outward where they might harm the shooter.

Figure 6:
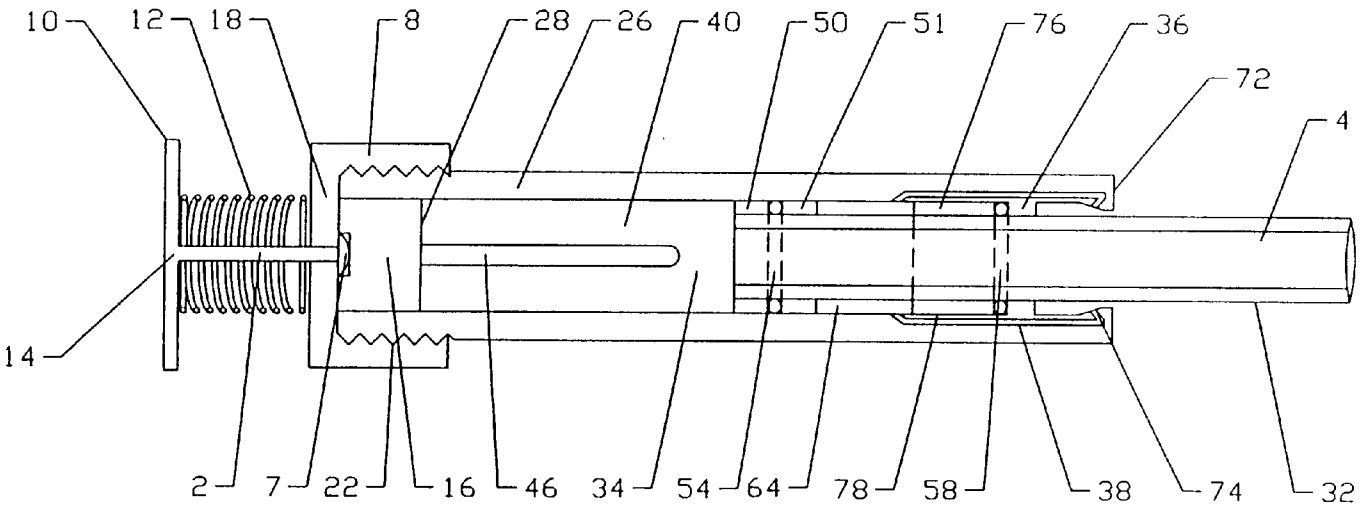
FIG. 6 is a sectional view of the gun after actuation.

Immediately forward breech block (18), a part of the metal in the inner wall of external barrel (26) is relieved along a longitudinal section of bore (34) by the formation of uninterrupted grooves (46), which extend through firing chamber (28) longitudinally extending forward within the inner metal wall of the barrel to a position lying above firing chamber (28) and adjacently forward the position occupied by annuluses (50, 51) of internal barrel (32) as indicated at (40), in FIG. 6, when gun is assembled. At a position adjacently above the proximal base of internal barrel (32), the axially extending grooves (46) in the internal surface of external barrel (26) end, and bore (34) of the barrel becomes smooth and continuous.

Cartridge (16) seated in firing chamber (28) in position to be fired by the forward movement of striker (2) is of unconventional design and shape. In order to force the propellant gas to accelerate both projectile (30) and internal barrel (32) and also to allow the propellant gas to flow through connecting grooves (46), the diameter of cartridge (16) is larger than that of projectile (30) and is of the approximate diameter of bore (34) of external barrel (26). Cartridge (16), used in this invention, has no shoulder, and is composed of a material, such as cardboard, which ruptures in the early stage of propellant combustion. Since part of the propellant energy is used to accelerate both projectile (30) and internal barrel (32) and part is channeled to forward chamber (64), the amount of smokeless powder contained in cartridge (16) is greater than that contained in conventional cartridges capable of attaining similar projectile velocities. The cartridge (16), is preferably of the type in which a semi-rigid piston (44) is secured within the top rim of cartridge (16) and is actuated by the propellant gas to provide the impact necessary to accelerate both the projectile (30) and internal barrel (32). Semi-rigid piston (44) is a disc composed of a material such as plastic of a predetermined thickness and of a diameter which is slightly smaller than bore (34) of external barrel (26). Because diameter of semi-rigid piston (44) is larger than bore (4) of internal barrel (32), the combustion gases are prevented from influencing projectile (30) directly until a firing chamber pressure develops that ruptures or bends the piston (44). Semi-rigid piston (44) is then usually expelled from internal barrel (32) following projectile (30). By varying the strength of piston (44), firing chamber (28) pressure and also the pressure of the gases in forward chamber (64) can be manipulated. The base of the projectile (30) is fixedly secured to the center area of semi-rigid piston (44), as indicated at (47) prior to ammunition loading.

Forward firing chamber (28) in bore (34) of external barrel (26); internal barrel (32) is disposed. Internal barrel (32) is completely enclosed by external barrel (26) along its longitudinal axis and is an elongated one-piece cylindrical imperforate metal barrel having both ends open and with a smooth unobstructed bore (4). Surrounding the outer metal surface at the extreme proximal end, two metal rings or annuluses (50) (51), of identical dimensions, are fixedly secured to the barrel and the annuluses (50) (51) are spaced apart to house a common rubber o-ring (54). When disposed within the gun, the base of most proximal annulus (50) abuts the rim area of semi-rigid cartridge piston (44) and within bore (4) of internal barrel (32), projectile (30) is enclosed. Annuluses (50) (51) and o-ring (54) communicate circumferentially with the interior surface of external barrel (26). The far end of internal barrel (32) is surrounded and supported by internal distal flange (36) and flange (36) is similar in height to annuluses (50, 51) of internal barrel (32), so the barrel is supported on its near and far ends by external barrel (26). When internal barrel (32) is placed in the gun, a common rubber o-ring (58), of suitable dimensions, is placed around distal end of internal barrel (32) a short distance behind the muzzle end of the barrel, so that the o-ring (58) abuts the internal metal surface of flange (36) and rests on external barrel (26). This o-ring (58) helps prevent the escape of gas from forward chamber (64) through internal barrel (32)—flange (36) junction when gun is actuated. Internal barrel (32) is not significantly constrained within the gun and is free to slide forward, piston-like, moving for a distance within external barrel (26), and extending forward from the front end of the barrel, stopping, in design, when forward annulus (51) meets flange (36). Internal barrel (32) slides forward when gun is actuated. When gun is at rest the muzzle terminus of internal barrel (32) is flush with the outer surface of flange (36).

The internal area in the gun defined by the space between flange (36) of external barrel (26), the forward annulus (51) of internal barrel (32), the interior surface of external barrel (26), and the exterior surface of internal barrel (32) make up an air space within the gun, as indicated at (66), called forward chamber (64). It is into this forward chamber (64) that some propellant gases are directed, upon firing, by means of grooves (46) in external barrel (26).

When grooves (46) in external barrel (26) terminate, the inner wall of barrel becomes smooth and continuous for a longitudinal distance extending distally. The interior surface of the external barrel (26) remains continuous until a point near the flange (36)—o-ring (58) position, the inner wall of the barrel becomes interspersed with small holes or voids (38) extending into the metal body of external barrel (26). Voids (38) are symmetrically disposed circularly along the inner circumference of external barrel (26) and extend radially for a short distance into the metal body of the barrel and then change direction to proceed longitudinally forward toward the muzzle portion of the gun within the metal body of external barrel (26). The direction of the voids (38) proceeds forward, uninterrupted, through the area in the gun, which is adjacent to flange (36) of external barrel (26). After flange (36) ends, the only purpose of extending the metal structure of the barrel in a forward direction is to provide a means of containing and directing voids (38) and the high pressure gases they will eventually contain. The metal body of external barrel (26) extends forward a short distance distal the location of flange (36) as a series of metal protrusions (72), housing and directing voids (38) as they deliver pressurized gases from forward chamber (64) of gun. The protrusions (72) are vaguely fish-hook in shape, so voids (38) that they contain, can proceed forward from the gun (corresponding to the long portion of a fish hook) and then turn around to point in a rearward direction (corresponding to the hook portion). The turn in voids (38) and protrusions (72) is not completely around 180° from the front of gun to the rear of gun, but preferably a turn of approximately 150°. The rearward direction is necessary in order that the expulsion of pressurized gas from voids (38) be used to overcome recoil forces of gun. Protrusions (72) and voids (38) on the forward end of external barrel (26) are directed radially inward, so all the gases are directed toward rear and interior of the gun or more specifically on to internal barrel (32) surface, which is moving forward out of external barrel (26) upon firing. By directing the gas on the forward moving internal barrel (32), the jets of hot gases are expelled in a manner, which safely diffuses the gas and also counters the force of the gun's recoil.

Located in forward chamber (64) between flange (36)—o-ring (58) junction and voids (38), an ablative mechanism (76) is positioned. This member surrounds internal barrel (32) along the barrel's distal external circumference and also fits tightly and communicates with the internal circumferential surface of external barrel (26). The mechanism is positioned forward the location of voids (38) and resting against flange (36)—o-ring (58) junction at the distal end of the gun. Ablative mechanism (76) consists of an elongated cylinder of elastomeric material (78) with air pockets or tunnels (80) extending longitudinally through the cylindrical interior of elastomer (78) from the base of the tube, axially to the top of the tube, as indicated at (82). Tunnels (80) are spaced at regular intervals within the elastomer body in order to allow the gas in forward chamber (64) to press or bear evenly upon the elastomer's interior surface when the gun is actuated. Elastomer tube (78) is securely affixed with a thin layer of abrasive material (84) (resinous aluminum oxide, etc.) around the elastomer's inner circumferential concave surface. When gun is assembled for use, ablative mechanism (76) is placed around the distal end of internal barrel (32) with abrasive material (84) resting against the exterior internal barrel (32) surface. During the gun's assembly, internal barrel (32) with ablative mechanism (76) around distal end, is pushed into bore (34) of external barrel (26) until ablative mechanism (76) contacts o-ring (58) resting against flange (36) on external barrel (26), then, the barrel resists any further forward movement. The purpose of ablative mechanism (76) is to aid in controlling the speed of internal barrel (32) as it moves within the gun upon actuation. Upon firing, the gas pressure in forward chamber (64) rises, due to inflow of propellant gas from firing chamber (28) through grooves (46) in external barrel (26). This pressure bears upon the elastomer tube (78), which in turn bears upon abrasive layer (84) of the mechanism. As internal barrel (32) moves forward, ablative material ablates the barrel's metal surface, thus slowing it. By varying the coarseness of the abrasive material (84) that is made to ablate the metal surface of the forward moving internal barrel (32), the speed of the barrel may be adjusted.

The firing of projectile (30) may be accomplished by manual retraction of rod (10) against the action of spring (12) and subsequent release of rod (10), which causes firing pin (2) to be snapped forward, firing cartridge (16).

Since cartridge (16) is composed of a semi-rigid material such as cardboard, the case ruptures in the early stages of smokeless powder oxidation and some of the propellant gases begin to be transferred by grooves (46), in the wall of firing chamber (28), to forward chamber (64) within the gun. Grooves (46) in wall of external barrel (26) can be of a depth and number so as to confine the majority of the propellant gas within the gun's firing chamber (28), or as is usually desired, flood forward chamber (64) with combustion gases so that the pressure in forward chamber (64) approximates firing chamber (28) pressure as propellant propagation progresses. Once the gases enter forward chamber (64), the increase in pressure in this chamber causes some gas to exit through voids (38) located in the distal portion of forward chamber (64). The total cross-sectional area of voids (38) are preferably less than the total cross-sectional area of grooves (46), so the amount of gas entering forward chamber (64) is greater than the amount leaving through voids (38), during stages of propellant burning. As the propellant burns, the pressure in firing chamber (28) reaches a point where semi-rigid piston (44) impacts base of projectile (30) and base of internal barrel (32) and accelerates both parts. Since semi-rigid piston (44) is the approximate diameter of the base of internal barrel (32), it must rupture in its center area in order for the propellant gases to influence the base of projectile (30). Once this takes place, the gun is designed so that the velocity of projectile (30) is at all times greater or equal to the velocity of internal barrel (32). The mechanical processes which govern projectile's (30) motion, are similar to those of conventional guns. Projectile (30) moves unimpeded through a barrel pushed forward by propellant gases and constrained by its mass and the frictional forces within the barrel. The forward motion of internal barrel (32) is also governed by the motion equation, F=ma. The acceleration of internal barrel (32) is directly proportional to the force applied by the propellant gases and inversely proportional to the barrel's mass and the frictional forces within the external barrel (26) through which it moves. The propellant force applied to internal barrel (32) and projectile (30) operates through breech or firing chamber (28) pressure. Pressure is force per unit area. If the base unit area of internal barrel (32) is increased (by increasing the size of base annulus of internal barrel (32) relative to the caliber of projectile (30), the force upon the barrel and consequently the acceleration of the barrel will increase relative to projectile (30), if the mass of each remains relatively the same. By manipulation of the base areas of projectile (30) and internal barrel (32), the velocity of internal barrel (32) can be made to exceed the velocity of projectile (30), when gun is fired, if so desired.

Internal barrel (32), the breech face of which abuts cartridge (16), is held in place within the gun by the frictional forces of the barrel's annuluses (50, 51) and o-ring (54) bearing against the inner wall of external barrel (26). When the pressure in firing chamber (28) rises high enough to rupture semi-rigid piston (44), projectile (30) is accelerated forward.

In reduction to practice, semi-rigid piston (44) is designed to rupture very soon after impacting the base of internal barrel (32) and projectile (30). The role of semi-rigid piston (44) can be disregarded, therefore, in approximating the forces governing the movement of projectile (30) and internal barrel (32). The acceleration imparted to projectile (30) can be approximated by multiplying firing chamber (28) pressure by the area of the base of projectile (30) and dividing this result by projectile's (30) mass. The acceleration of internal barrel (32) can be best approximated by subtracting from the base area of internal barrel (32), the base area increase which is due to annulus (50), then multiplying the result by firing chamber (28) pressure and dividing this result by the mass of internal barrel (32), since the side of annulus (51) facing forward chamber (64) is usually opposed by a gas pressure from that chamber nearly equal to the gas pressure in firing chamber (28) bearing on the annulus's (50) base side.

Since grooves (46) extend forward on the inner wall of external barrel (26) to a position adjacently above the position annuluses (50, 51) on internal barrel (32) occupy when gun is at rest, once internal barrel (32) starts moving, grooves (46) keep transferring gas between firing chamber (28) and forward chamber (64) until internal barrel (32) reaches the point where the grooves (46) terminate. At this point, the gas exchange between the two chambers is at a minimum and the forward movement of internal barrel (32) forces the trapped gases forward to exit through voids (38) in the muzzle end of external barrel (26), while the pressure in firing chamber (28) forces internal barrel (32) and projectile (30) forward. It is thought that the cross-sectional area of voids (38) should be kept small so that, upon firing, as the internal barrel (32) moves up the external barrel (26), the gas pressure in forward chamber (64) is made to rise, and thus, the resulting gas pressure in forward chamber (64), bearing against forward annulus (51) of internal barrel (32) is then sufficient to stop internal barrel (32) within confines of external barrel (26). The venting of gases from forward chamber (64) through voids (38) is thought to take place even after projectile (30) leaves the gun. The gases in the forward chamber (64) are forced from voids (38) through protrusions (72), which are directed at an acute angle with the vertical plane of the gun, pointing inward toward the center of the gun and rearward toward the proximal portion of the gun. The high velocity gases are thereby directed against the outer surface of internal barrel (32) as the barrel telescopes within external barrel (26) upon firing. In this manner, the high velocity gases counter the force of the gun's recoil and slow to some extent, the motion of internal barrel (32). As this is happening, projectile (30) moves through bore (4) of internal barrel (32) and exits the muzzle end of the barrel. The work of internal barrel (32) in forcing the gases from forward chamber (64) helps slow and stop the barrel within the confines of external barrel (26). After firing, internal barrel (32) usually extends forward from external barrel (26), held by the frictional force of ablative mechanism (76).

The velocity of the jet stream of gases leaving voids (38) is a function of the pressure in forward chamber (64) at the time the gases exit. Changing the pressure in forward chamber (64) may be accomplished in a variety of ways, among them: altering the strength of semi-rigid piston (44), altering weight of internal barrel (32), altering the frictional forces acting on internal barrel (32). These changes all effect the flow of gases from firing chamber (28) to forward chamber (64). At a constant predetermined pressure, the mass of the gases in forward chamber (64) can be effected by altering the size of forward chamber (64). The momentum (mass multiplied by velocity) of the expelled gases can be contrived to equal the momentum imparted to the gun upon firing. Diverting a portion of the propellant gases to forward chamber (64), compressing them by the motion of internal barrel (32) while expelling the gases in a direction opposite or nearly opposite that of projectile (30) can result in an efficient means of generating a gaseous jet stream with a momentum that acts to counter the recoil momentum of the gun.

Upon firing, the increase in pressure in forward chamber (64) also causes elastomer (78) to bear upon abrasive material (84) affixed to concave surface of ablative mechanism (76), and offer frictional resistance to the movement of internal barrel (32).

The gun can be re-fired by unscrewing breech cap (8) from external barrel (26) removing fired cartridge (16), repositioning internal barrel (32) and ablative mechanism (76), replacing a live cartridge (16) with projectile (30) so that the rim of cartridge (16) abuts the base annulus (50) of internal barrel (32) with projectile (30) enclosed within bore (4).

This gun is thought to be designed differently from conventional guns in the following major ways. A brief explanation of the reasons for the differences in design is necessary for the readers' understanding of the invention.

Firing chamber (28) is designed to contain only cartridge (16) and to expedite the transfer of some propellant gas to forward chamber (64) within the gun.

Cartridge (16) is designed to include a case composed of a material which ruptures in the early stages of propellant detonation so as to allow some of the propellant gas to contact grooves (46) in firing chamber (28) and be transported to forward chamber (64) as the propellant burns and as maximum pressure in firing chamber (28) is effected.

Propellant is preferentially the slower burning type smokeless powder in order to facilitate the accumulation of propellant gas in forward chamber (64) of the gun.

A piston (44) of the semi-rigid type is used to separate projectile (30) from the smokeless powder in ammunition design. This allows better control and manipulation of the point when the breech pressures effect projectile (30), since semi-rigid piston (44), being of larger diameter than bore (4) of internal barrel (32) must rupture in order for the propellant gases to accelerate projectile (30).

External barrel (26) is designed to provide a means for channeling propellant gases from firing chamber (28) to forward chamber (64) through the inclusion of grooves (46) located in the proximal region of the barrel. It is also designed to provide a means of expelling these gases from the gun in a manner which can reduce the gun's recoil through the disposition of voids (38) in external barrel's (26) distal area. The external barrel (26) is also designed to include a mechanism for ablating the surface of internal barrel (32) as it moves through the gun in order to help control the speed of internal barrel (32).

Internal barrel (32) is designed to move forward upon actuation primarily to reduce the force of the gun's recoil. The primary reason for requiring internal barrel (32) to move forward when propelling projectile (30) is to use the kinetic energy contained in the moving barrel in a way that counters the force of the gun's recoil. This is done in this invention, by requiring the moving internal barrel (32) push a compressed gas from the gun in a direction and with a force that neutralizes the recoil force acting on the gun resulting from the projectile's (30) forward motion. The propellant energy is converted into kinetic energy of the moving barrel and that kinetic energy is converted into the mechanical energy of a compressed gas being made to exit rapidly from a mechanical nozzle. As the moving barrel's kinetic energy is converted into mechanical energy, the barrel slows down and when the energy is expanded, the barrel stops. The major problem concerning a gun that is designed to accomplish this energy conversion, is stopping the moving barrel within the confines of the gun and in a manner which does not damage the internal barrel (32) or other parts of the gun, so that the damaged parts of the gun must be replaced before the gun can be used again. It is thought than most of the energy of the moving internal barrel (32) can be utilized to counteract recoil if the variables involved in this gun design are manipulated until this object is accomplished.

When internal barrel (32) is pushed forward past the point in external barrel (26) where grooves (46) terminate in external barrel (26), the flow of gas into forward chamber (64) from firing chamber (28) ceases or is at a minimum, and the moving internal barrel (26) is pushed forward by the breech pressure, if projectile (30) is still in bore (4) of internal barrel (32) at the time.

If projectile (30) exits internal barrel (32) before internal barrel (32) reaches the point in external barrel (26) where grooves (46) end, internal barrel (32) will still move forward due to inertia, and do work to counter the force of the gun's recoil, however, the recoil reduction will not be as great as had the internal barrel (32) been forced for a greater distance up the bore (34) of external barrel (26) by firing chamber (28) pressure.

The speed of internal barrel (32) is critical in forcing the gases in forward chamber (64) from the gun, through voids (38) at a velocity significant to counter recoil. The speed of internal barrel (32) is dependent on its mass, the area of its breech face, the type and amount of smokeless powder used in the ammunition, and the pressure of the gases in forward chamber (64), that internal barrel (32) must move against. Increasing the size or number of voids (38) in external barrel (26) increases internal barrel (32) speed through the gases in forward chamber (64).

By changing the coarseness and strength of the abrasive material (84) of ablative mechanism (76) located in external barrel (26), the speed of internal barrel (32), as it moves within the gun, may be altered. The pressure in forward chamber (64) also influences the ablating efficiency of ablative mechanism (76). Increasing or decreasing the number and depth of grooves (46) in firing chamber (28) of external barrel (26), influences the transfer of gases to forward chamber (64) and consequently the pressure in the chamber may be regulated.

The foregoing disclosure and description of the invention is illustrative only. Various changes may be made within the scope of the appended claims without departing from the spirit of invention.

I claim:

1. A gun for directing a projectile, said gun comprising:

(a) an external barrel having an inner wall forming a hollow interior within said external barrel, said external barrel having a forward end and having a rear end; said external barrel having an internal metal flange extending into said hollow interior and causing said hollow interior of said external barrel to have a narrowed internal diameter thereat; said internal flange having a proximal side remote from said forward end; said external barrel being terminated at said rear end by a breech block having a striker housing aperture therethrough; said hollow interior having a firing chamber portion adjacent said breech block, said firing chamber portion being adapted for holding a firing cartridge therewithin;

(b) a forwardly-slidable internal barrel disposed within said external barrel, said internal barrel being an elongated one-piece cylinder of imperforate metal having an outer surface and having a distal end and having a proximal end; said internal barrel being open on said distal end and on said proximal end and having an unobstructed bore extending therethrough from said distal end to said proximal end; said internal barrel including an external metal annulus secured thereabout adjacent said proximal end, said annulus having a distal side remote from said proximal end; said distal end of said internal barrel being supported and surrounded by said internal flange of said external barrel;

said gun having a forward chamber therewithin bounded by said distal side of said annulus of said internal barrel, by said proximal side of said internal flange of said external barrel, by said outer surface of said internal barrel, and by said inner wall of said external barrel;

said gun further having at least one concave groove formed within said internal wall of said external barrel and extending longitudinally from within said firing chamber, past said annulus of said internal barrel, and to said forward chamber.

2. The gun as recited in claim 1, wherein said gun further has a plurality of passageway voids disposed within said external barrel, each of said passageway voids having a first opening through said inner wall of said external barrel into said forward chamber and a rearwardly-facing second opening.

3. A gun for directing a projectile, said gun comprising:

(a) an external barrel having an inner wall forming a hollow interior within said external barrel, said external barrel having a forward end and having a rear end; said external barrel having an internal metal flange extending into said hollow interior and causing said hollow interior of said external barrel to have a narrowed internal diameter thereat; said internal flange having a proximal side remote from said forward end; said external barrel being terminated at said rear end by a breech block having a striker housing aperture therethrough; said hollow interior having a firing chamber portion adjacent said breech block, said firing chamber portion being adapted for holding a firing cartridge therewithin; said external barrel including a plurality of protrusions extending forwardly from said flange;

(b) a forwardly-slidable internal barrel disposed within said external barrel, said internal barrel being an elongated one-piece cylinder of imperforate metal having an outer surface and having a distal end and having a proximal end; said internal barrel being open on said distal end and on said proximal end and having an unobstructed bore extending therethrough from said distal end to said proximal end; said internal barrel including a first external metal annulus and a second external metal annulus secured thereabout adjacent said proximal end, said first annulus and said second annulus being spaced apart from each other on said internal barrel and said second annulus being forward of said first annulus and said second annulus having a forward-facing distal side; said distal end of said internal barrel being supported and surrounded by said internal flange of said external barrel;

said gun having a forward chamber therewithin bounded by said distal side of said second annulus of said internal barrel, by said proximal side of said internal flange of said external barrel, by said outer surface of said internal barrel, and by said inner wall of said external barrel;

said gun further having at least one concave groove formed within said internal wall of said external barrel and extending longitudinally from within said firing chamber, past said first annulus and said second annulus of said internal barrel, and to said forward chamber;

said gun further having a plurality of passageway voids disposed within said external barrel, each of said passageway voids having a first opening through said inner wall of said external barrel into said forward chamber and a rearwardly-facing second opening in one of said plurality of protrusions, each said passageway void having a turn therewithin of greater than ninety degrees.

4. The gun as recited in claim 3, wherein said gun further comprises an elongated tube of elastomeric material disposed within said forward chamber; said elongated tube having an abrasive inner cylindrical surface in communication with said outer surface of said internal barrel; said elongated tube having an outer surface being in communication with said inner wall of said external barrel; said elongated tube having a rearward end and having a forward end, said elongated tube further having a plurality of spaced tunnels extending longitudinally therethrough from said rearward end of said elongated tube to said forward end of said elongated tube.

* * * * *